US006616503B1

(12) United States Patent
Fong

(10) Patent No.: US 6,616,503 B1
(45) Date of Patent: Sep. 9, 2003

(54) ANIMATION DEVICE FOR HEAD AND MOUTH OF A TOY

(76) Inventor: Peter Sui Lun Fong, 505a 5/F Empire Centre, 68 Mody Road, East Tsimshatsui, Kowloon (HK)

( * ) Notice: Subject to any disclaimer, the term of this patent is extended or adjusted under 35 U.S.C. 154(b) by 0 days.

(21) Appl. No.: 10/127,241

(22) Filed: Apr. 22, 2002

(51) Int. Cl.[7] ..... A63H 11/00; A63H 13/00; A63H 3/20

(52) U.S. Cl. ..... 446/330; 446/353; 74/25; 74/53

(58) Field of Search ..... 446/330, 355, 446/354, 353, 352, 356, 337, 338; 40/419, 420, 414; 74/25, 27, 54, 55, 53

(56) References Cited

U.S. PATENT DOCUMENTS 4,828,530 A * 5/1989 Lee ..... 446/354
4,869,703 A * 9/1989 Ong ..... 446/353
5,413,517 A * 5/1995 Kamijima ..... 446/354
5,966,853 A * 10/1999 Yeh ..... 446/337
6,017,261 A * 1/2000 Wachtel ..... 446/353
6,135,848 A * 10/2000 Hou ..... 446/353
6,343,970 B1 * 2/2002 Lee et al. ..... 446/330
6,454,626 B1 * 9/2002 An ..... 446/330

* cited by examiner

*Primary Examiner*—Derris H. Banks
*Assistant Examiner*—Urszula m Cegielnik
(74) *Attorney, Agent, or Firm*—Stetina Brunda Garred & Brucker

(57) ABSTRACT

An animation device for integration into an animated figure having a head with a jaw. The animation device comprises a cam assembly which is cooperatively engage to the jaw of the animated figure. The cam assembly is configured for linear movement along a first axis concurrently with pivotal movement about second and third axes which extend in generally perpendicular relation to each other and to the first axis. Mechanically coupled to the cam assembly is an actuation motor which is operative to facilitate the movement of the cam assembly along the first axis concurrently with movement about the second and third axes.

14 Claims, 11 Drawing Sheets

ANIMATION DEVICE FOR HEAD AND MOUTH OF A TOY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

1. Field of the Invention

The present invention relates generally to animated figures, and more particularly to a compact, inexpensive animation device for imparting realistic, lifelike movements to the head and mouth of a toy such as a doll or a soft toy animal.

2. Background of the Invention

There have been known for many years various types of animated figures and toys which are capable of performing various movements in sequences and/or combinations as convey a life-like appearance. Such animated figures are often found in amusement parks, with more simplified animated toys being available commercially in many toy stores or the toy departments of various retail establishments. The animated figures often seen in amusement parks are generally of extremely complex construction, and include many motors which are operative to facilitate the movements of various body parts of the figure (e.g., the head, eyes, mouth, arms, legs, etc.). The control of these many motors is typically facilitated by a central processor which is programmed to coordinate the actuation of the motors as needed to impart to the animated figure life-like movements. As will be recognized, these animated figures are highly sophisticated, expensive devices, typically unsuitable for the consumer market.

Those animated figure (e.g., toys) which are suited for the consumer market are substantially less complex, and thus substantially less expensive than the above-described "amusement park" animated figures. In this regard, presently available animated figures such as dolls and soft toy animals are typically provided with one or more motors capable of facilitating a limited range of movement of one or more corresponding body parts of the figure. Those animated figures including a single motor which facilitates the movement of one corresponding body part tend to be on the less expensive side of the price scale, but are extremely limited in their ability to provide life-like movements to the figure. Those animated figures or dolls which include multiple motors facilitating the movement of multiple body parts, while imparting a more life-like movement pattern and appearance to the figure, tend to be extremely costly due to the large number of motors included in the device, and hence more prone to failure since the failure of even a single motor may compromise the functionality of the entire device.

The present invention addresses these and other deficiencies of animated figures, soft toy animals and dolls currently available to consumers by providing an animation device for imparting to a toy such as a doll or a soft toy animal realistic, life-like head and mouth movements. The animation device of the present invention is capable of allowing movement along one axis concurrently with rotation about two other axes, with such movements imparting a life-like appearance to the doll, soft toy animal, or other figure. These, and other features of the present invention, will be discussed in more detail below.

BRIEF SUMMARY OF THE INVENTION

In accordance with the present invention, there is provided an animation device for integration into an animated figure having a head and a movable jaw. The animation device comprises a cam assembly which is cooperatively engaged to the jaw of the animated figure. The cam assembly is configured for linear movement along a first axis concurrently with rotational or pivotal movement about second and third axes which extend in generally perpendicular relation to each other and to the first axis. Mechanically coupled to the cam assembly is an actuation motor which is operative to facilitate the movement of the cam assembly along the first axis concurrently with movement about the second and third axes.

In the animation device of the present invention, the cam assembly is cooperatively engaged to the jaw in a manner wherein the movement of the cam assembly along the first axis facilitates the movement of the jaw between open and closed mouth positions. The movement of the cam assembly about the second axis facilitates the movement of the head in an arcuate path between right and left positions, with the movement of the cam assembly about the third axis facilitating the movement of the head in an arcuate path between forward and backward positions. The movement of the jaw along the first axis concurrently with the movement of the head about the second and third axes imparts to the animated figure a realistic, life-like animated effect.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
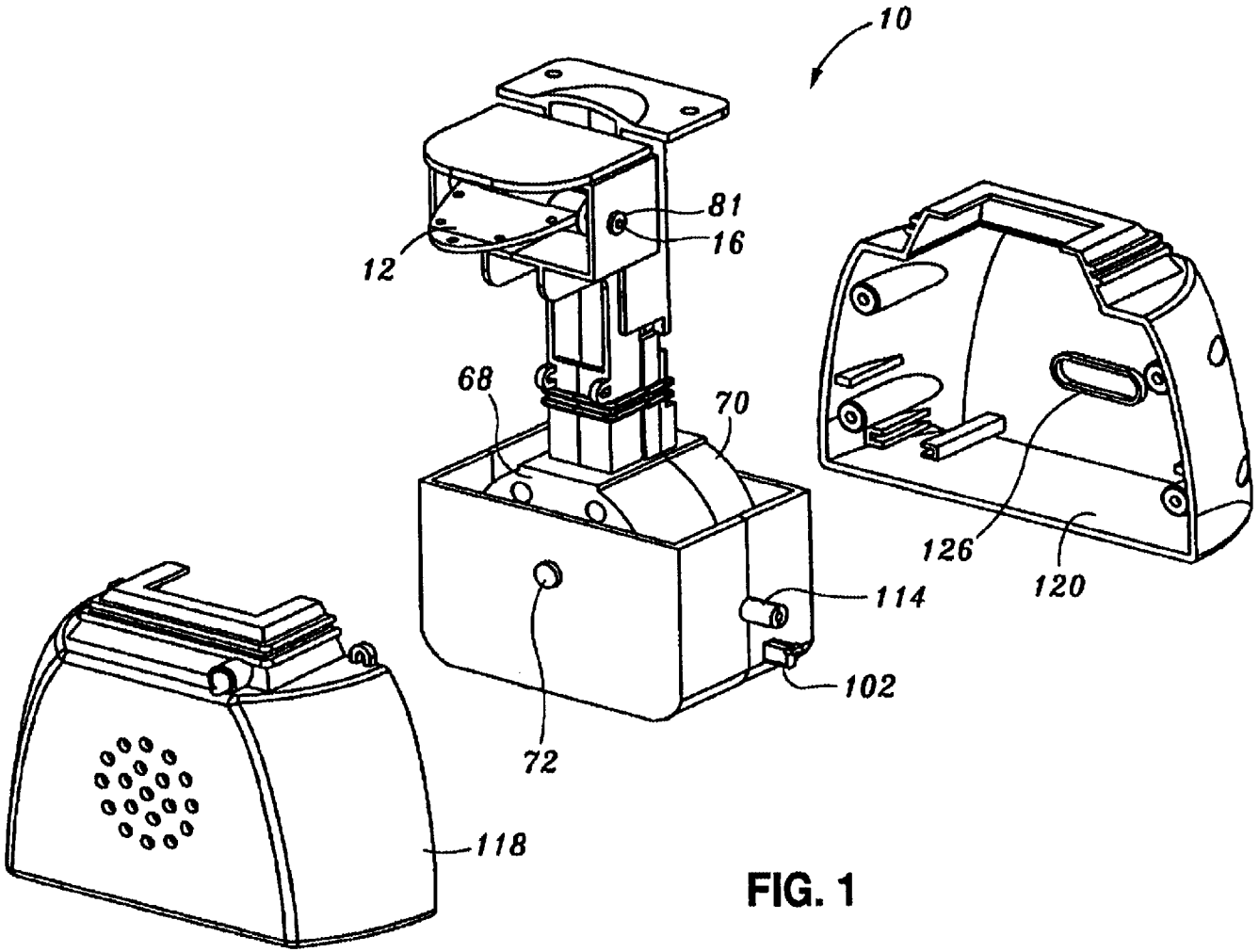
FIG. 1 is a partial exploded view of the animation device of the present invention taken from a front perspective, illustrating with particularity the front and rear outer casings thereof.

Referring now to the drawings wherein the showings are for purposes of illustrating a preferred embodiment of the present invention only, and not for purposes of limiting the same, FIGS. 1–8 provide various exploded views of the head and mouth animation device 10 constructed in accordance with the present invention. It is contemplated that the animation device 10 will be integrated into an animated figure or toy, such as a doll or soft toy animal. As will be discussed in more detail below, the animated device 10 is specifically adapted to impart to the animated figure (doll) various head and mouth movements which create an animated, life-like effect. More particularly, the animated device 10 is adapted to facilitate the opening and closing of the figure's mouth, the movement of the head along an arcuate path between right and left positions, and the movement of the head along an arcuate path between front and rear positions. These various movements may occur simultaneously in various sequences, depending on the desired animation effect. The control and coordination of such movement(s) is facilitated by a central processing unit (e.g., a microprocessor) as will also be discussed in more detail below. The animation device 10 is able to impart these various movements to the animated figure, soft toy animal or doll through the use of only a single motor, thus causing the animated figure including the animation device 10 to be more simplified in construction and thus less costly to manufacture than those known in the prior art, while at the same time providing superior animated effects.

Figure 5:
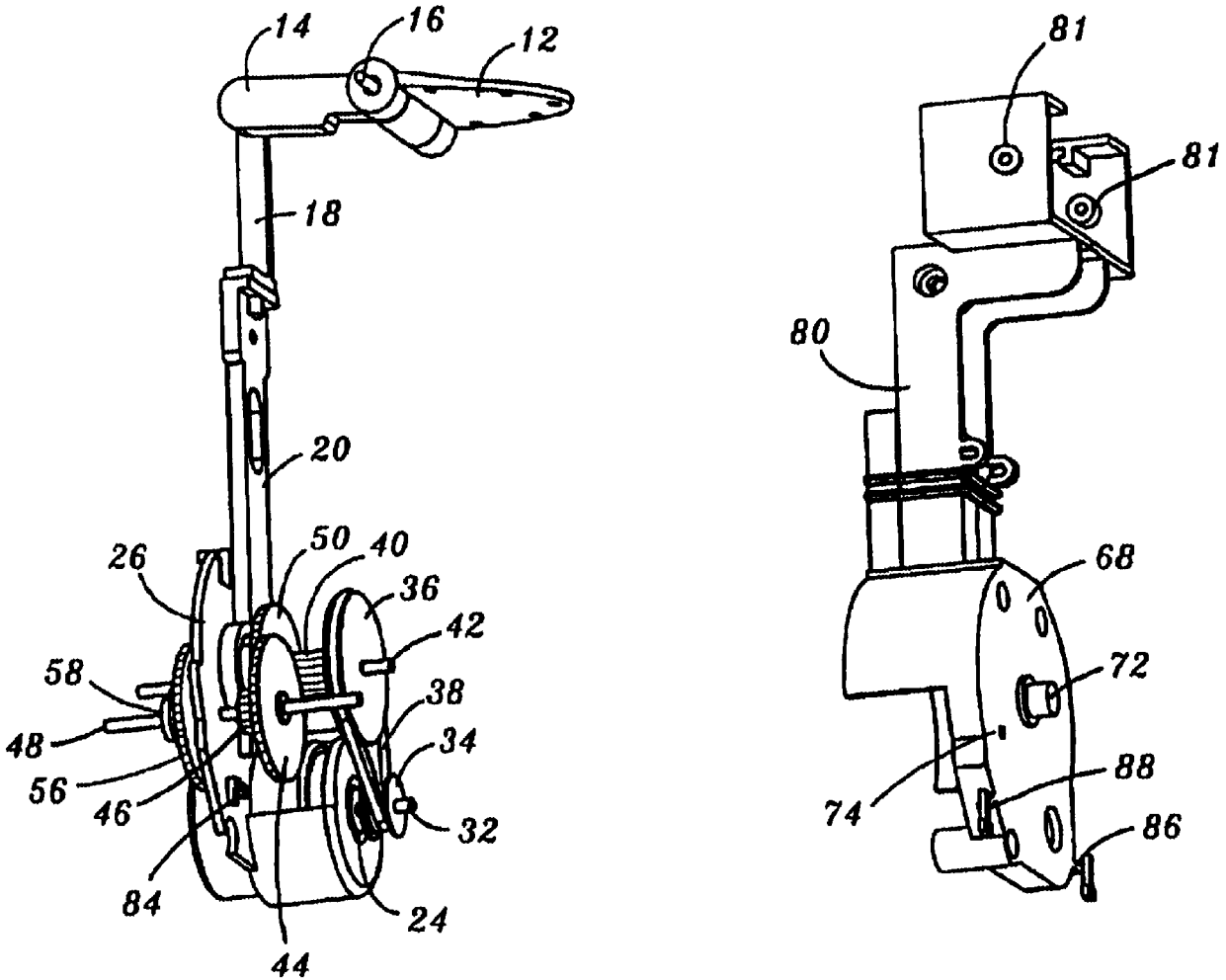
FIG. 5 is a partial exploded view of the present animation device taken from a front perspective, illustrating with particularity the gear train used to drive the eccentric cams thereof.
Figure 6:
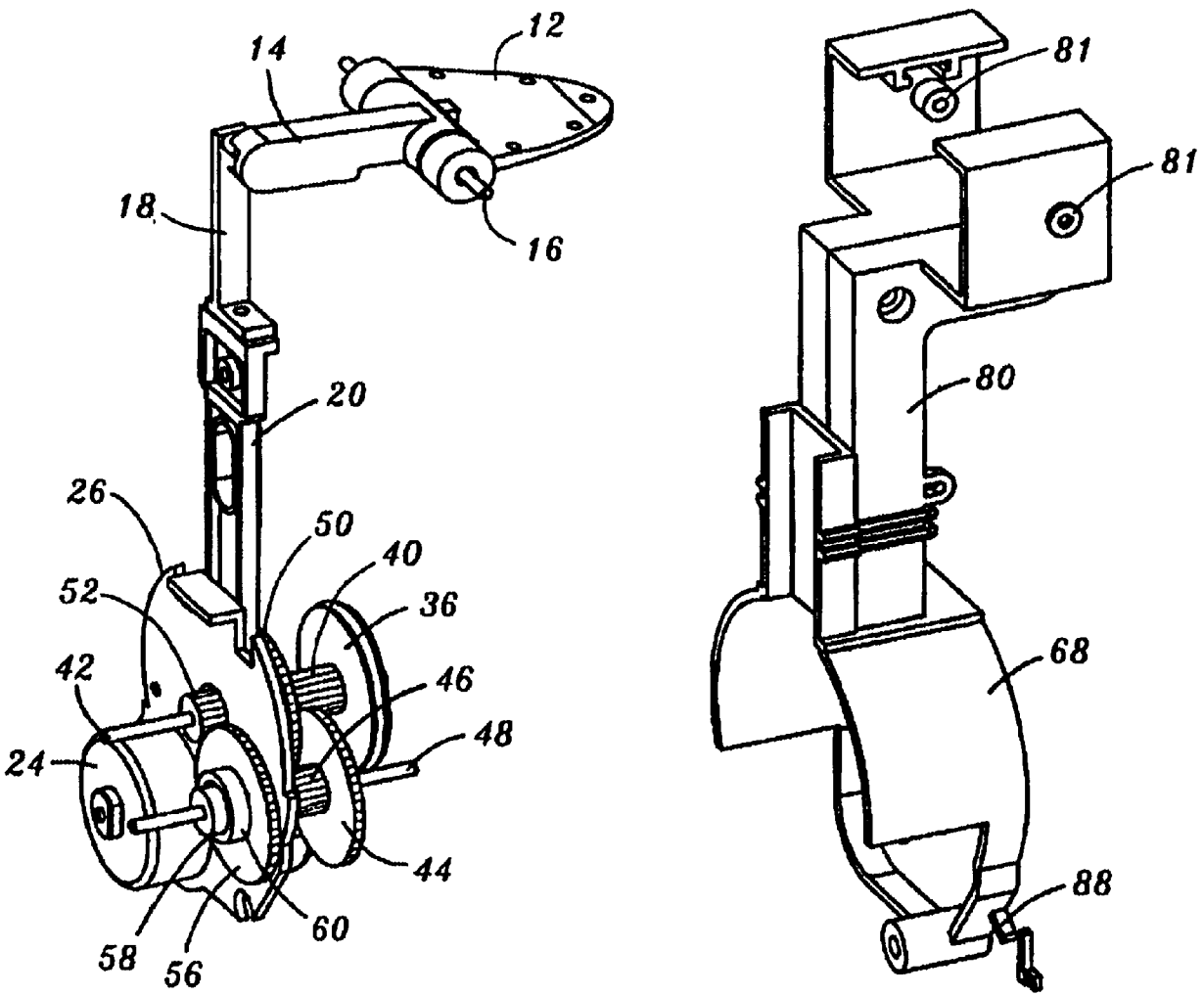
FIG. 6 is a partial exploded view of the present animation device taken from a rear perspective as compared to FIG. 5.
Figure 7:
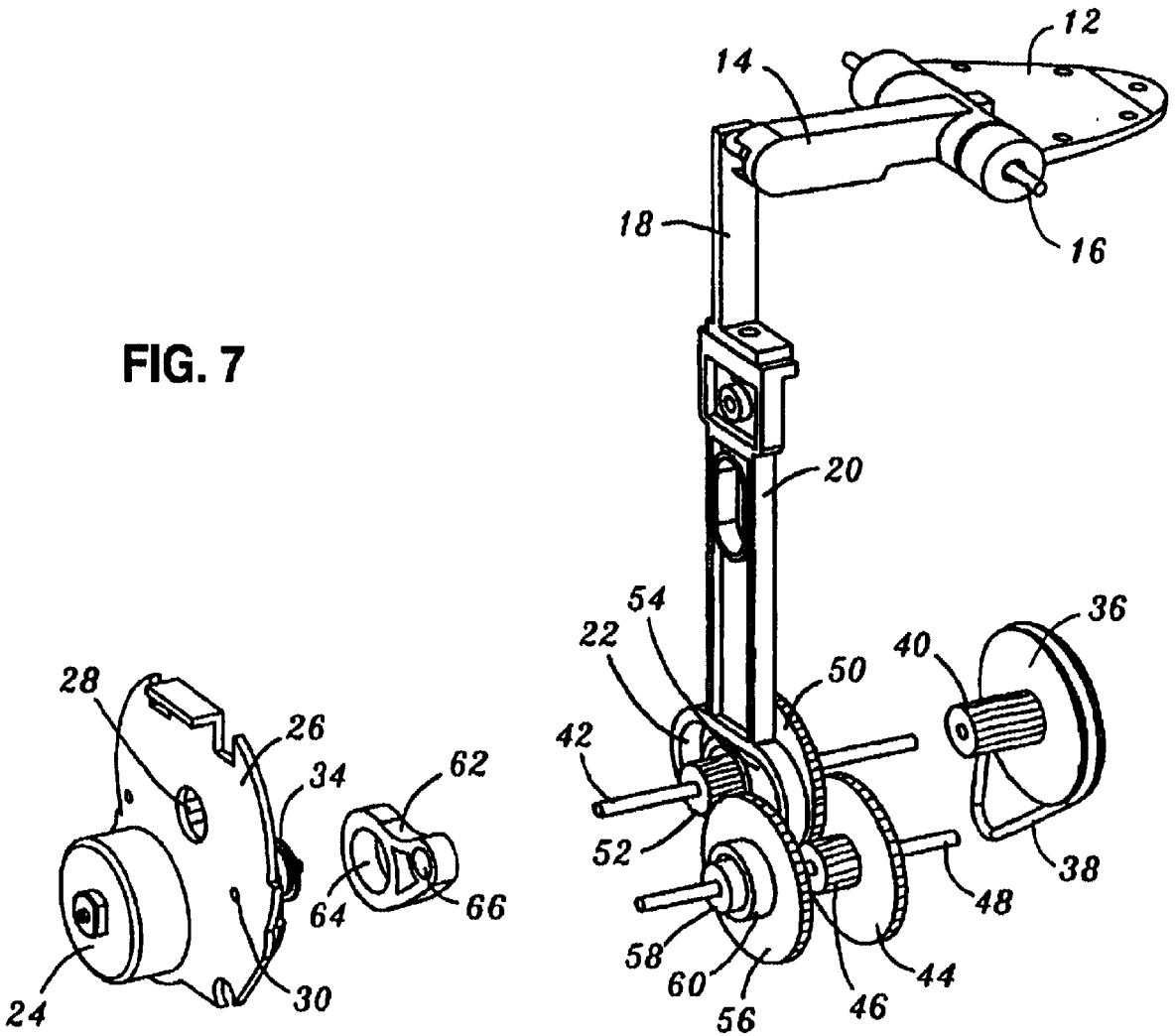
FIG. 7 is a partial exploded view of the present animation device taken from a left rear perspective.
Figure 8:
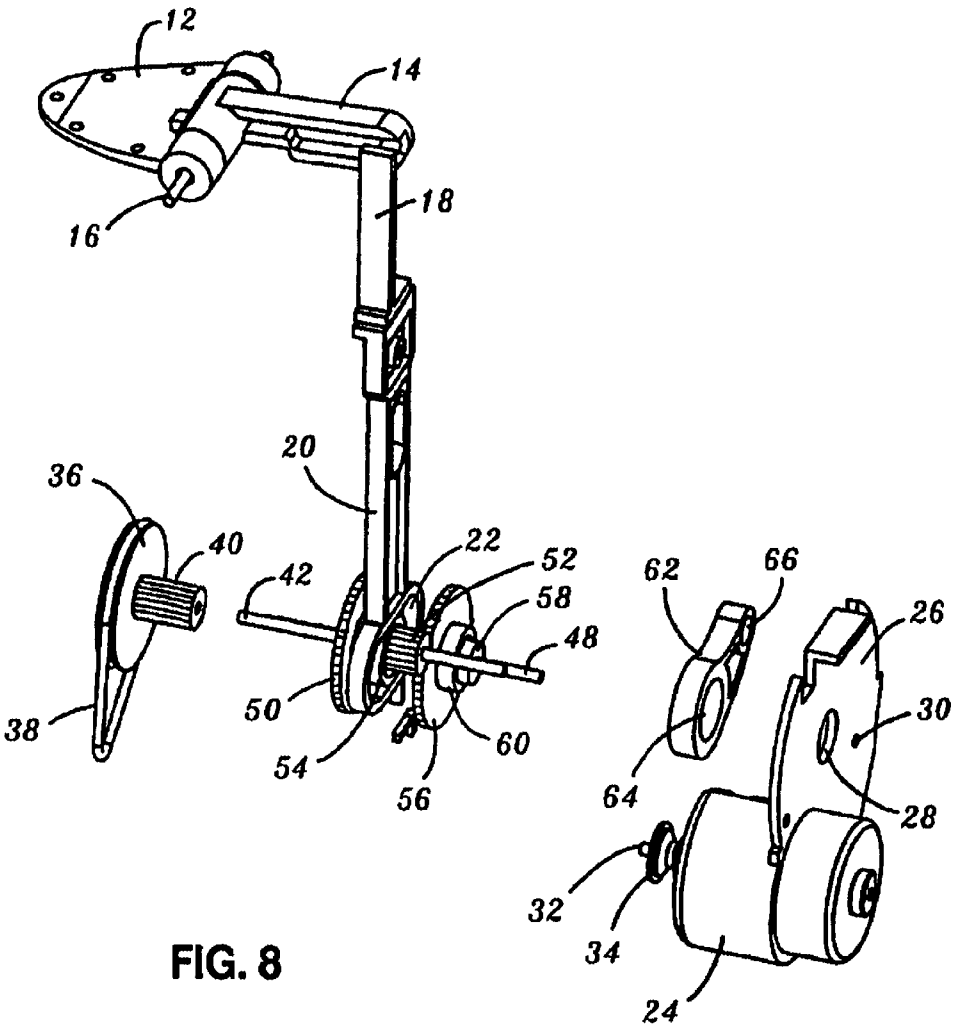
FIG. 8 is a partial exploded view of the present animation device taken from a right rear perspective as compared to FIG. 7.

As shown in FIGS. 1–8, the animated device 10 comprises a lower jaw plate 12 which has a generally elliptical configuration. The lower jaw plate 12 is connected to a jaw support 14 via a jaw pin 16. Pivotally connected to the distal end of the jaw support 14 (the end disposed furthest from the jaw pin 16) is the top end of an elongate jaw strut 18. The opposite, bottom end of the jaw strut 18 is rigidly attached to the top end of an elongate first cam follower 20. As best seen in FIGS. 7 and 8, the first cam follower 20 is formed to include an enlarged bottom end which defines an elongate first cam slot 22.

Referring now to FIGS. 4–8, the animation device 10 further comprises a reversible actuation motor 24 which is attached to a motor mount plate 26. Disposed in the approximate center of the motor mount plate 26 is a circularly configured opening 28. Also disposed within the motor mount plate 26 is a pin aperture 30. The use of the opening 28 and pin aperture 30 will be discussed in more detail below. Protruding from one end of the actuation motor 24 is a drive shaft 32 having a first pulley 34 mounted thereto. The first pulley 34 is operatively coupled to a second pulley 36 via a drive belt 38 extending therebetween. Attached to and extending axially from the circularly configured second pulley 36 is a reduced diameter first gear 40. The second pulley 36 and first gear 40 collectively define an axially extending central aperture which slidably accommodates an elongate, cylindrically configured first pin 42. The first pin 42 is advanced into and through such central aperture.

As best seen in FIG. 6, the first gear 40 is intermeshed with a second gear 44. Attached to and extending axially from the circularly configured second gear 44 is a reduced diameter third gear 46. The second and third gears 44, 46 collectively define a continuous aperture extending axially therethrough. This aperture has a circular cross-sectional configuration, and is sized to slidably accommodate an elongate second pin 48 which has a generally square cross-sectional configuration. In this regard, the diameter of the aperture collectively defined by the second and third gears 44, 46 is sized to slightly exceed the diagonal width of the second pin 48 which is. advanced through such aperture. The second pin 48 is also slidably advanced through the pin aperture 30 of the motor mount plate 26, with the pin aperture 30 also having a diameter which exceeds the diagonal width of the second pin 48, thus allowing the second pin 48 to be rotatable therein.

In the animation device 10, the third gear 46 is intermeshed with a fourth gear 50 which, like the second pulley 36 and first gear 40, is rotatably mounted to the first pin 42. Attached to and extending axially from the circularly configured fourth gear 50 is a reduced diameter fifth gear 52 which is advanced through the opening 28 within the motor mount plate 26. The fourth and fifth gears 50, 52 collectively define an aperture which is sized to slidably accommodate the first pin 42. In this regard, the first pin 42 is also extended through the aperture collectively defined by the fourth and fifth gears 50, 52, with the fourth and fifth gears 50, 52 thus being rotatable upon the first pin 42. Due to the advancement of the first pin 42 through the fifth gear 52, the first pin 42 also extends through the opening 28 within the motor mount plate 26 in the manner best shown in FIG. 6.

As best seen in FIGS. 7 and 8, also attached to the side of the fourth gear 50 having the fifth gear 52 extending therefrom is an annular first cam 54. The first cam 54 does not extend axially from the fourth gear 50, but rather is radially offset such that the fifth gear 52 does not extend through the center or axis of the first cam 54. The first cam follower 20 of the animation device 10 is positioned between the fourth gear 50 and the motor mount plate 26 such that the first cam 54 is advanced into and slidably movable within the first cam slot 22.

In the animation device 10, the activation of the actuation motor 24 facilitates the rotation of the first pulley 34, and hence the second pulley 36 attributable to the extension of the drive belt 38 therebetween. The rotation of the second pulley 36 in turn facilitates the rotation of the first gear 40 attached thereto. Due to the intermesh between the first and second gears 40, 44, the rotation of the first gear 40 facilitates the concurrent rotation of the second gear 44. Due to the size disparity between the first and second gears 40, 44, the second gear 44 rotates at a slower rate of speed than the first gear 40. The rotation of the second gear 44 facilitates the rotation of the third gear 46 which is attached thereto. Due to the intermesh between the third gear 46 and the fourth gear 50, the rotation of the third gear 46 facilitates the concurrent rotation of the fourth gear 50. The relative sizes of the third and fourth gears 46, 50 causes the fourth gear 50 to be rotated at a reduced rate of speed as compared to the third gear 46.

The rotation of the fourth gear 50 facilitates the concurrent rotation of both the fifth gear 52 and first cam 54 which are attached thereto. The fifth gear 52 rotates within the opening 28 of the motor mount plate 26, with the first cam 54 rotating within the first cam slot 22 of the first cam follower 20. Due to the first cam 54 being radially offset from the axis of the fourth gear 50, the rotation of the first cam 54 within the first cam slot 22 facilitates the reciprocal upward and downward vertical movement of the first cam follower 20. Such reciprocal movement of the first cam follower 20 in turn results in the reciprocal upward and downward pivotal movement of the jaw support 14, and hence the lower jaw plate 12.

Figure 14A:
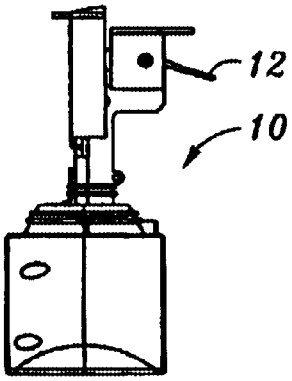
FIGS. 14A–14B are side elevational views of the present animation device, illustrating the open and closed mouth positions, respectively, thereof.
Figure 14B:
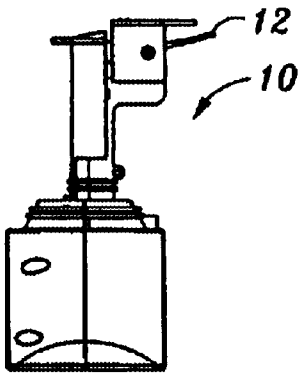

As indicated above, it is contemplated that the animation device 10 of the present invention will be integrated into an animated figure such as a doll or a soft toy animal. In this application, the lower jaw plate 12 will be disposed within the doll or soft toy animal head and cooperatively engaged to a moveable lower jaw thereof. The opposed ends of the jaw pin 16 are pivotally connected to corresponding bosses within another component of the animation device 10 as will be described below. The upward vertical movement of the first cam follower 20 as a result of the rotation of the first cam 54 facilitates the downward pivotal movement of the lower jaw plate 12, and hence the movement of the animated doll mouth to an "open mouth" position (FIG. 14A) Conversely, the downward movement of the first cam follower 20 as a result of the rotation of the first cam 54 results in the upward pivotal movement of the lower jaw plate 12 and hence the movement of the animated doll mouth to a "closed mouth" position (FIG. 14B).

As further seen in FIGS. 3–8, the animation device 10 also includes a sixth gear 56 which is mounted to the second pin 48. Attached to and extending axially from the sixth gear 56 is a cylindrically configured first boss 58 having a diameter which is substantially less than that of the circularly configured sixth gear 56. The sixth gear 56 and first boss 58 collectively define an aperture having a generally square cross-sectional configuration which is complementary to that of the second pin 48. In this regard, the second pin 48 is advanced through such aperture, with the rotation of the sixth gear 56 (and hence the first boss 58) thus facilitating the rotation of the second pin 48. The rotation of the second pin 48 is facilitated for reasons which will be discussed in more detail below. Also attached to and extending from the side of the sixth gear 56 having the first boss 58 extending therefrom is an annular second cam 60. Like the first cam 54 described above, the second cam 60 does not extend axially from the sixth gear 56, but rather is radially. offset such that the first boss 58 does not extend axially through the center of the second cam 60, but rather is itself offset toward one side thereof. In the animation device 10, the fifth gear 52 is intermeshed with the sixth gear 56 such that the rotation of the fifth gear 52 will facilitate the concurrent rotation of the sixth gear 56. Due to the relative sizes of the fifth and sixth gears 52, 56, the sixth gear 56 will rotate at a speed slower than that of the fifth gear 52. Due to the attachment of the second cam 60 thereto, the rotation of the sixth gear 56 in turn facilitates the rotation of the second cam 60.

Operatively coupled to the second can 60 is a second cam follower 62 which is shown in FIGS. 7 and 8. The second cam follower 62 defines a circularly configured primary opening 64 and a smaller, circularly configured secondary opening 66. The size of the primary opening 64 is complementary to the second cam 60, with the cooperative engagement of the second cam follower 62 to the second cam 60 being facilitated by the advancement of the second cam 60 into the primary opening 64. Due to the second cam 60 being offset from the axis of the sixth gear 56, the rotation of the sixth gear 56 facilitates the back and forth reciprocal movement of the second cam follower 62 which gives rise to functionality discussed in more detail below.

Referring now to FIGS. 3–6, the first through sixth gears 40, 44, 46, 50, 52, 56, actuation motor 24, motor mount plate 26, and second cam follower 62 are disposed between a front inner casing 68 and a rear inner casing 70 of the animation device 10. Disposed in the approximate center of the front inner casing 68 is a cylindrical boss 72 having an aperture extending axially therethrough which is sized and configured to receive and rotatably support the front end of the first pin 42. Also disposed within the front inner casing 68 is an aperture 74 which is laterally offset from the boss 72 and is configured to receive and rotatably support the front end of the second pin 48. Similarly, disposed within the approximate center of the rear inner casing 70 is a boss 76 having an aperture extending axially therethrough which is sized to receive and rotatably support the rear end of the first pin 42. Also disposed within the rear inner casing 70 is an aperture 78 which is sized and configured to receive and rotatably support the second pin 48. As will be discussed in more detail below, the second pin 48 is sized such that it is advanced through the aperture 78. Integrally connected to and extending upwardly from the front inner casing 68 is a front support member 80, while integrally connected to and extending upwardly from the rear inner casing 70 is a rear support member 82. When the front and rear inner casings 68, 70 are connected to each other, the front and rear support members 80, 82 collectively define a support and guide structure for the first cam follower 20, jaw strut 18, jaw support 14, and lower jaw plate 12. The front support member 80 includes a pair of bosses 81 disposed thereon in opposed relation to each other. The opposed ends of the jaw pin 16 are pivotally connected to respective ones of the bosses 81. It will be recognized that portions of the front and rear support members 80, 82 (as well as the first cam follower 20 and jaw strut 18) will extend through the neck of the animated figure, soft toy animal or doll, with the upper portions of the front and rear support members 80, 82 as well as the jaw support 14 and lower jaw plate 12 residing within the head of the animated figure, soft toy animal or doll.

Figure 11:
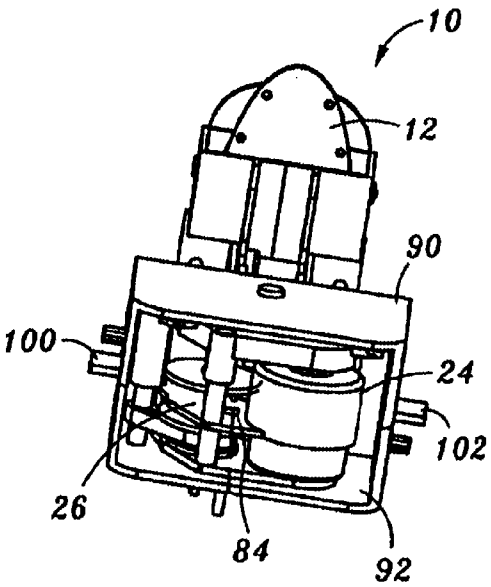
FIG. 11 is a partial, bottom perspective view of the present animation device, illustrating the mouth closing contact switch thereof.

As seen in FIGS. 5 and 11, attached to the motor mount plate 26 below the first cam follower 20 is a mouth contact switch 84. The downward movement of the first cam follower 20 to the closed mouth position shown in FIG. 14B will facilitate contact between the bottom end of the first cam follower 20 and the mouth contact switch 84 in a manner actuating the mouth contact switch 84. The actuation of the mouth contact switch 84 transmits a signal to the control circuitry of the animation device 10 indicative of the downward movement of the first cam follower 20 to its downward limit, and hence the movement of the lower jaw plate 12 to the full, closed mouth position. Additionally, as seen in FIGS. 5 and 6, formed on opposite sides of the lower portion of the front inner casing 68 is a left contact switch actuator 86 and a right contact switch actuator 88, the use of which will be discussed in more detail below.

In the animation device 10, the front and rear inner casings 68, 70 are disposed between and rotatably connected to a front middle casing 90 and a rear middle casing 92. Disposed within the front middle casing 90 is a circularly configured aperture 94, while disposed within the rear middle casing 92 is a circularly configured aperture 96. Also disposed within the rear middle casing 92 in spaced relation to the aperture 96 is an arcuately contoured slot 98.

Additionally, formed on and extending inwardly from the inner surface of the rear middle casing 92 is an elongate, cylindrically configured cam boss 99. Further, formed on and extending outwardly from one side wall of the front middle casing 90 is a front contact switch actuator 100. Similarly, formed on and extending outwardly from one side wall of the rear middle casing 92 is a rear contact switch actuator 102. The use of the front and rear contact switch actuators 100, 102 will be described in more detail below.

Figure 10:
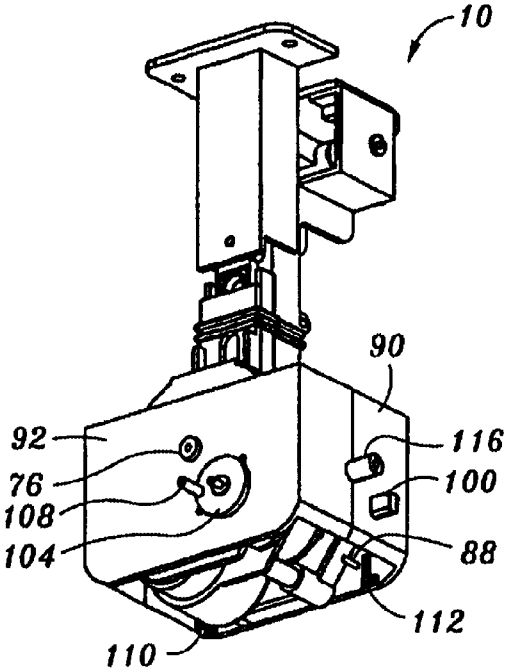
FIG. 10 is a partial, bottom perspective view of the present animation device, illustrating the left and right position contact switches thereof.

In the animation device 10, the boss 72 protruding from the front inner casing 68 is advanced into and rotatably supported within the aperture 94 which has a configuration complementary to that of the boss 72. Similarly, the boss 76 protruding from the rear inner casing 70 is advanced into and rotatably supported within the aperture 96 which has a configuration complementary to that of the boss 76. The receipt of the bosses 72, 76 into respective ones of the apertures 94, 96 facilitates the rotatable connection of the attached front and rear inner casings 68, 70 to the receptacle collectively defined by the attached front and rear middle casings 90, 92. When such rotatable connection is achieved, the second pin 48, in addition to being extended through the aperture 78, is also extended through the slot 98, with a portion of the second pin 48 protruding therefrom. Attached to such exposed portion of the second pin 48 is a circularly configured third cam 104. Extending axially through the third cam 104 is an aperture 106 which has a generally square cross-sectional configuration complementary to that of the second pin 48. Thus, upon the third cam 104 being mounted to the exposed portion of the second pin 48 (as shown in FIG. 10), the rotation of the second pin 48 facilitates the concurrent rotation of the third cam 104. Attached to and extending outwardly from the third cam 104 is a cylindrically configured cam extension 108 which is radially offset from the aperture 106, and hence the axis of the third cam 104.

Figure 13C:
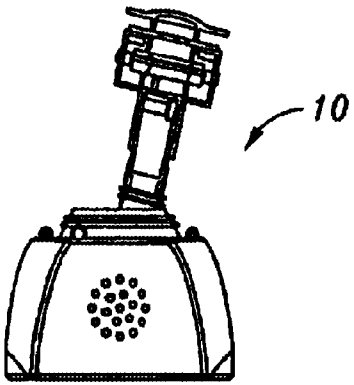
FIGS. 13A–13C are front elevational views of the present animation device, illustrating its range of motion between right and left positions.
Figure 13B:
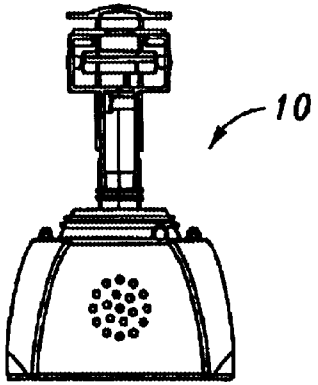
Figure 13A:
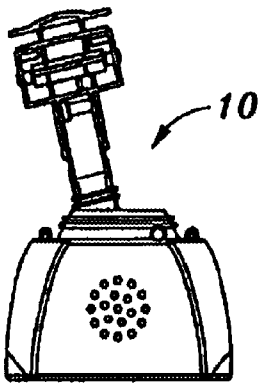

When the front and rear inner casings 68, 70 are attached to each other, only a portion of the second cam follower 62 is disposed therebetween, with that segment of the second cam follower 62 defining the secondary opening 66 protruding from the attached front and rear inner casings 68, 70. When the front and rear inner casings 68, 70 are rotatably connected to the front and rear middle casings 90, 92 in the above-described manner, the cam boss 99 of the rear middle casing 92 is advanced into and through the secondary opening 66 of the second cam follower 62. As indicated above, the second cam 60 may be rotated by the actuation motor 24 to facilitate the movement of the second cam follower 62 to one side or the other. Such movement effectively causes the joined front and rear inner casings 68, 70 (and hence the figure's head) to pivot (rock or tilt) along an arcuate path between right and left positions relative to the joined front and rear middle casings 90, 92. Importantly, the arcuate shape of the slot 98 accommodates the resultant movement of the second pin 48 in an arcuate path relative to the joined front and rear middle casings 90,92. Thus, the third cam 104 which is at the exterior of the joined front and rear middle casings 90, 92 moves with the second pin 48 along its arcuate path, in addition to being rotated thereby. Thus, the rotation of the second cam 60 and resultant movement of the second cam follower 62 allows those components of the animation device 10 interfaced to and supported by the front and rear inner casings 68, 70 to be moved relative to the front and rear middle casings 90, 92 along an arcuate path between right and left positions as shown in FIGS. 13A, 13B, and 13C.

As best seen in FIG. 10, mounted to the front middle casing 90 is a left contact switch 110 and a right contact switch 112. The pivoting or tilting of the joined front and rear inner casings 68, 70 (and hence the figure's head) to the right limit of movement (shown in FIG. 13A) facilitates the actuation of the left contact switch 110 by the left contact switch actuator 86. Similarly, the tilting movement of the joined front and rear inner casings 68, 70 (and hence the figure's head) to the left limit (shown in FIG. 13C) facilitates the actuation of the right contact switch 112 by the right contact switch actuator 88. As will be recognized, the actuation of either the left or right contact switches 110, 112 by respective ones of the left and right contact switch actuators 86, 88 facilitates the transmission of a signal to the control circuitry of the animation device 10 indicating that the right or left limit of movement has been achieved. As is further seen in FIGS. 9–11, the front and rear middle casings 90, 92 each include integral pairs of extensions which, when the front and rear middle casings 90, 92 are attached to each other, collectively define a cylindrically configured left boss 114 and a cylindrically configured right boss 116 which extends in opposed relation to the left boss 114. The use of the left and right bosses 114, 116 will be discussed below as well.

Figure 2:
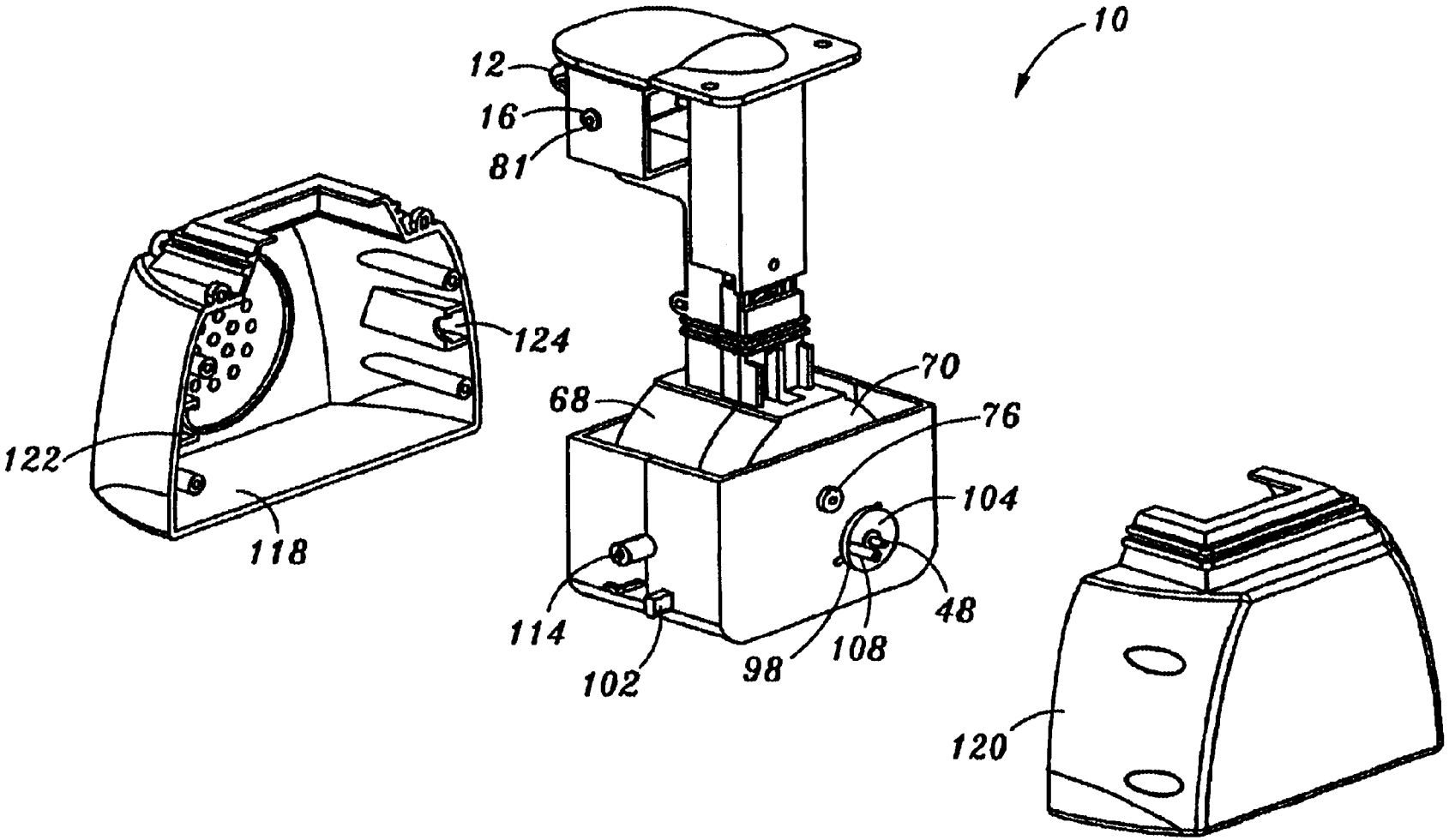
FIG. 2 is a partial exploded view of the present animation device taken from the rear perspective as compared to FIG. 1.
Figure 3:
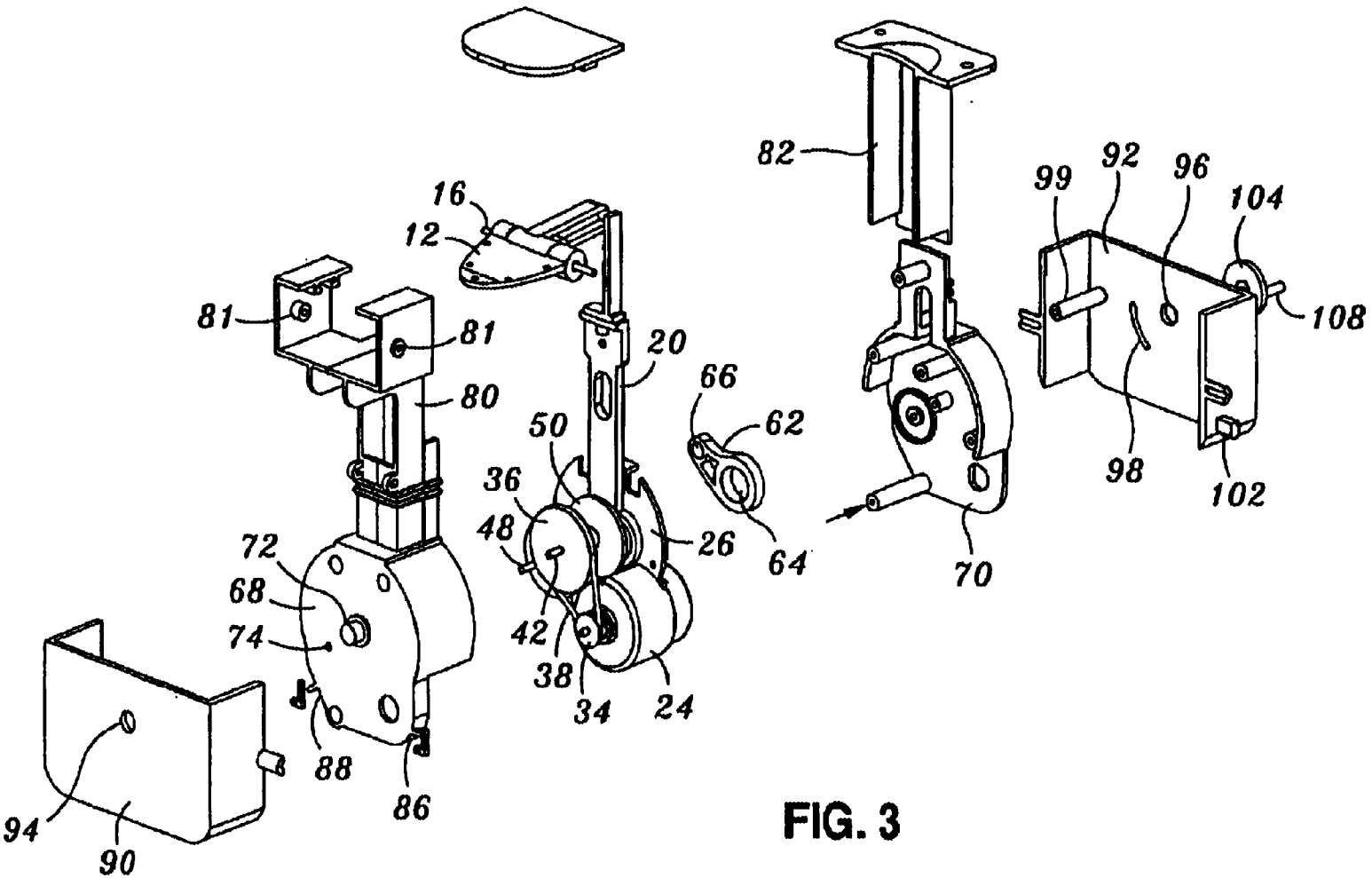
FIG. 3 is a partial exploded view of the present animation device taken from a front perspective, illustrating with particularity the front and rear middle casings and eccentric cams thereof.
Figure 4:
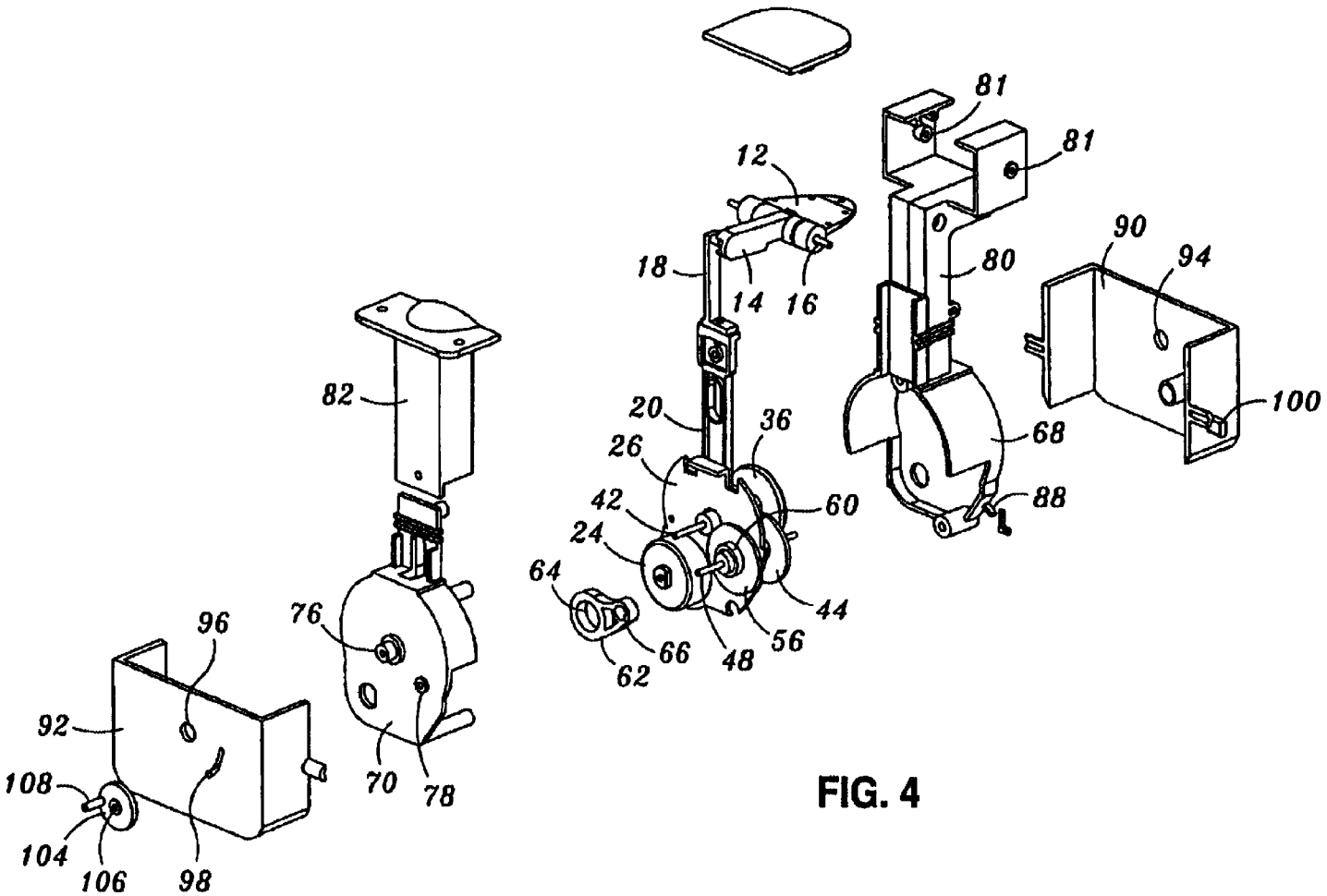
FIG. 4 is a partial exploded view of the present animation device taken from a rear perspective as compared to FIG. 3.

Referring now to FIGS. 1 and 2, the animation device 10 of the present invention further comprises a front outer casing 118 and a rear outer casing 120. The joined front and rear middle casings 90, 92 are pivotally/rotatably connected to the joined front and rear outer casings 118, 120. In this regard, formed within the front outer casing 118 is a left mounting slot 122 and a right mounting slot 124 which are identically sized and configured, and are adapted to receive the left boss 114 and right boss 116, respectively. When the front and rear outer casings 118, 120 are attached to each other, the left and right bosses 114, 116 are maintained and rotatable within respective ones of the left and right mounting slots 122, 124, thus allowing the joined front and rear middle casings 90, 92 to rock or tilt forward and backward relative to the joined front and rear outer casings 118, 120.

Figure 12C:
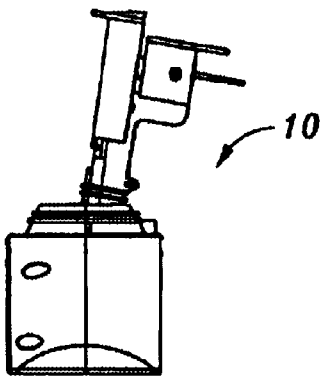
FIGS. 12A–12C are side elevational views of the present animation device, illustrating its range of motion between rear and front positions.
Figure 12B:
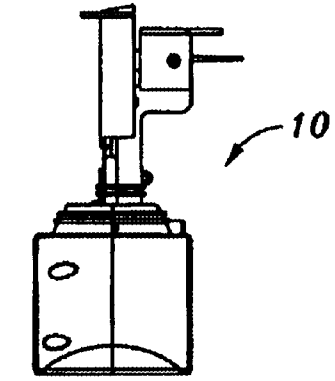
Figure 12A:
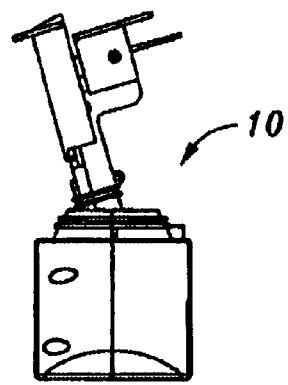

Formed on the inner surface of the back wall of the rear outer casing 120 is a third cam follower 126. When the front and rear outer casings 118, 120 are attached to each other with the joined front and rear middle casings 90, 92 being disposed therebetween, the cam extension 108 of the third cam 104 is advanced into the interior region defined by the third cam follower 126. As indicated above, the activation of the actuation motor 24 not only facilitates the rotation of the cam extension 108 about the axis of the second pin 48, but also the movement of the cam extension 108 along the arcuate path defined by the slot 98. When the cam extension 108 is advanced into the interior of the third cam follower 126 in the above-described manner, the rotation and arcuate movement of the third cam 104 causes the cam extension 108 to act against the third cam follower 126 in a manner facilitating the tilting or pivoting movement of the joined front and rear middle casings 90, 92 (and hence the figure's head) along an arcuate path between forward and backward positions relative to the joined front and rear outer casings 118, 120 as shown in FIGS. 12A, 12B, and 12C.

Figure 9:
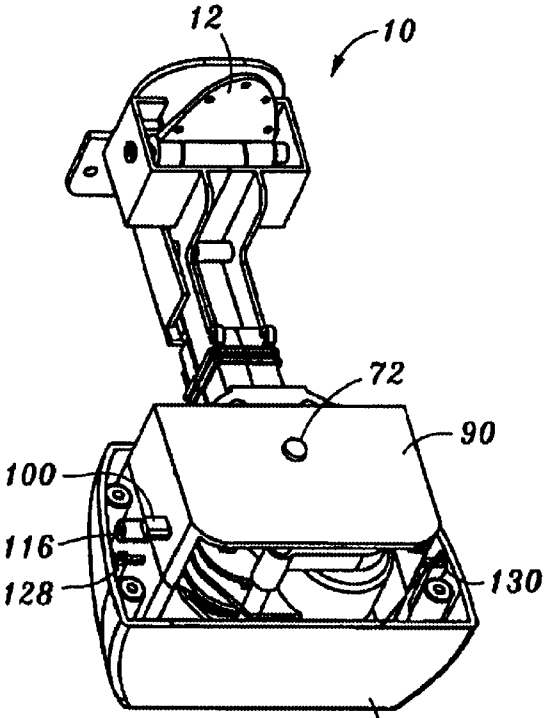
FIG. 9 is a partial, bottom perspective view of the present animation device, illustrating the front and rear position contact switches thereof.

As seen in FIG. 9, mounted within the rear outer casing 120 is a front contact switch 128 and a rear contact switch 130. The rotation or pivoting of the joined front and rear middle casings 90,92 to the frontal or forward limit (shown in FIG. 12C) results in the actuation of the front contact switch 128 by the front contact switch actuator 100. Conversely, the rotation of the joint front and rear middle casings 90, 92 to the rear rotational limit (shown in FIG. 12A) facilitates the actuation of the rear contact switch 130 by the rear contact switch actuator 102. The actuation of the front and rear contact switches 128, 130 by respective ones of the front and rear contact switch actuators 100, 102 facilitates the transmission of a signal to the control circuitry for the animation device 10 indicative of the joined front and rear middle casings 90, 92 reaching the front or rear rotational limits. It is contemplated that when the animation device 10 is integrated into an animated figure, soft toy animal or doll, the joined front and rear outer casings 118, 120 will typically be disposed within the chest area of such figure, soft toy animal or doll.

Figure 15:
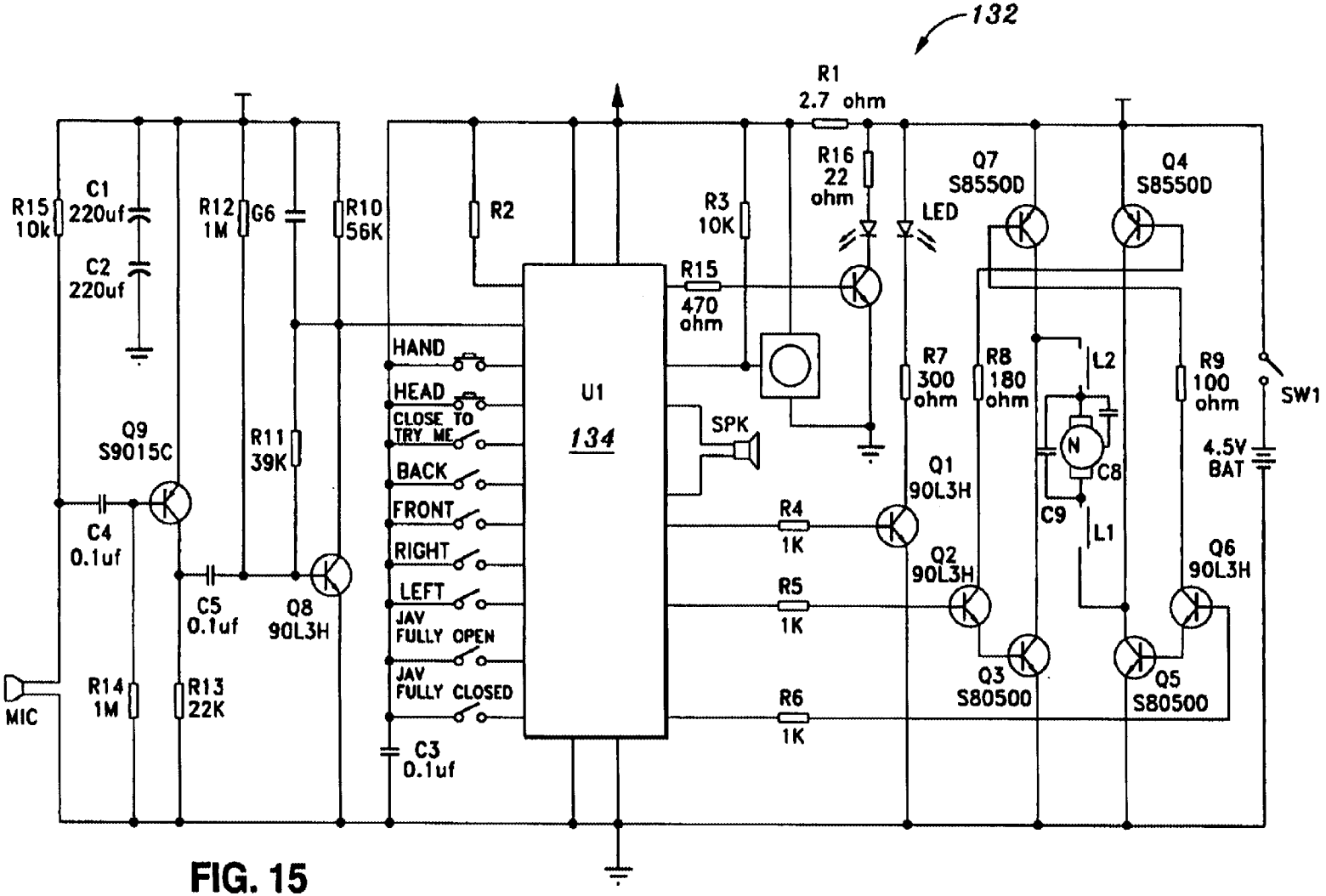
FIG. 15 is a schematic of exemplary electronic circuitry which may be used in conjunction with the animation device of the present invention.

FIG. 15 provides a schematic of exemplary control circuitry 132 which may be used to control and coordinate the various movements of the animation device 10 as described above. The control circuitry 132 includes a microprocessor 134 which is programmable, and provided with power from a power source (e.g., batteries) of the animated figure, soft toy animal or doll. Advantageously, the configuration of the animation device 10 imparts various movement capabilities to the head of the animated figure, soft toy animal or doll. These movement capabilities include the movement of the lower jaw of the figure, soft toy animal or doll between open and closed mouth positions (FIGS. 14A, 14B), the tilting of the head forward or backward (FIGS. 12A, 12B, 12C), and the tilting of the head to the right or to the left (FIGS. 13A, 13B, 13C). The control circuitry 132 may be programmed to facilitate these movements in any combination or sequence. The facilitation of such movements at the same time in a desired sequence achieves a realistic, life-like animated appearance with the animated figure, soft toy animal or doll. Advantageously, these attributes are achieved through the use of only a single motor (i.e., the actuation motor 24) which, in view of the configuration of the animation device 10, is able to facilitate the movement of the first cam follower 20 along one axis, while simultaneously allowing for the rotation thereof along two more axes which extend in perpendicular relation to each other and to the axis of the first cam follower 20. As will be recognized, the relative simplicity of construction of the animation device 10 reduces the costs thereof, and hence the costs of the animated figure, soft toy animal or doll into which it is incorporated, despite providing an extremely high level of movement/animation capability.

Additional modifications and improvements of the present invention may also be apparent to those of ordinary skill in the art. For example, the left and right contact switches 110, 112 and front and rear contact switches 128, 130 need not necessarily be included in the animation device 10. Thus, the particular combination of parts described and illustrated herein is intended to represent only one embodiment of the present invention, and is not intended to serve as limitations of alternative devices within the spirit and scope of the invention.

What is claimed is:

1. An animation device for integration into an animated figure having a head with a jaw, the animation device comprising:

a cam assembly cooperatively engaged to the jaw of the animated figure, the cam assembly being configured for linear movement along a first axis concurrently with pivotal movement about second and third axes which extend in generally perpendicular relation to each other and to the first axis; and an actuation motor mechanically coupled to the cam assembly and operative to facilitate the movement thereof along the first axis concurrently with movement about the second and third axes;

the cam assembly being cooperatively engaged to the jaw of the animated figure in a manner wherein the movement of the cam assembly along the first axis facilitates the movement of the jaw between open and closed mouth positions, the movement of the cam assembly about the second axis facilitates the movement of the head in an arcuate path between right and left positions, and the movement of the cam assembly about the third axis facilitates the movement of the head in an arcuate path between forward and backward positions.

2. The animation device of claim 1 wherein the cam assembly comprises:

an elongate first cam follower reciprocally moveable along the first axis;

a jaw plate cooperatively engaged to the jaw of the animated figure and mechanically coupled to the first cam follower in a manner wherein the movement of the first cam follower along the first axis facilitates the reciprocal pivotal movement of the jaw plate and resultant movement of the jaw between the open and closed mouth positions; and a first cam mechanically coupled to and rotatable by the actuation motor, the first cam being cooperatively engaged to the first cam follower such that the rotation of the first cam facilitates the reciprocal movement of the first cam follower along the first axis.

3. The animation device of claim 2 wherein the cam assembly further comprises:

a middle casing;

a second cam mechanically coupled to and rotatable by the actuation motor, the second cam and the actuation motor being at least partially disposed within the middle casing; and a second cam follower cooperatively engaged to the second cam and the middle casing such that the rotation of the second cam facilitates the movement of the first cam follower about the second axis relative to the middle casing.

4. The animation device of claim 3 wherein the cam assembly further comprises:

an outer casing;

a third cam mechanically coupled to and rotatable by the actuation motor, the third cam and the middle casing being at least partially disposed within the outer casing; and a third cam follower disposed within the outer casing and cooperatively engaged to the third cam such that the rotation of the third cam facilitates the movement of the first cam follower about the third axis relative to the outer casing.

5. The animation device of claim 4 further comprising:

a mouth contact switch attached to the cam assembly in a location whereat the mouth contact switch is actuated by the first cam follower when the jaw reaches the closed mouth position.

6. The animation device of claim 5 further comprising:

an inner casing disposed within the middle casing, the actuation motor, the first cam follower, the first cam, the second cam follower, and the second cam being at least partially disposed within the inner casing;

left and right contact switches disposed between the inner and middle casings at locations whereat the left contact switch is actuated by the inner casing when the head reaches the right position and the right contact switch is actuated by the inner casing when the head reaches the left position; and front and rear control switches disposed between the middle and outer casings at locations whereat the front control switch is actuated by the middle casing when the head reaches the forward position and the rear control switch is actuated by the middle casing when the head reaches the backward position.

7. An animation device, comprising:

a cam assembly configured for linear movement along a first axis concurrently with pivotal movement about second and third axes which extend in generally perpendicular relation to each other and to the first axis; and an actuation motor mechanically coupled to the cam assembly and operative to facilitate the movement thereof along the first axis concurrently with movement about the second and third axes.

8. The animation device of claim 7 wherein the cam assembly comprises:

an elongate first cam follower reciprocally moveable along the first axis;

a jaw plate mechanically coupled to the first cam follower in a manner wherein the movement of the first cam follower along the first axis facilitates the reciprocal movement of the jaw plate; and a first cam mechanically coupled to and rotatable by the actuation motor, the first cam being cooperatively engaged to the first cam follower such that the rotation of the first cam facilitates the reciprocal movement of the first cam follower along the first axis.

9. The animation device of claim 8 wherein the cam assembly further comprises:

a middle casing;

a second cam mechanically coupled to and rotatable by the actuation motor, the second cam and the actuation motor being at least partially disposed within the middle casing; and a second cam follower cooperatively engaged to the second cam and the middle casing such that the rotation of the second cam facilitates the movement of the first cam follower about the second axis relative to the middle casing.

10. The animation device of claim 9 wherein the cam assembly further comprises:

an outer casing;

a third cam mechanically coupled to and rotatable by the actuation motor, the third cam and the middle casing being at least partially disposed within the outer casing; and a third cam follower disposed within the outer casing and cooperatively engaged to the third cam such that the rotation of the third cam facilitates the movement of the first cam follower about the third axis relative to the outer casing.

11. The animation device of claim 10 further comprising:

a mouth contact switch attached to the cam assembly in a location whereat the mouth contact switch is actuated by the first cam follower when the first cam follower reaches a lower position limit.

12. The animation device of claim 11 further comprising:

an inner casing disposed within the middle casing, the actuation motor, the first cam follower, the first cam, the second cam follower, and the second cam being at least partially disposed within the inner casing;

left and right contact switches disposed between the inner and middle casings at locations whereat the left contact switch is actuated by the inner casing when the first cam follower reaches a right position limit and the right contact switch is actuated by the inner casing when the first cam follower reaches a left position limit; and front and rear control switches disposed between the middle and outer casings at locations whereat the front control switch is actuated by the middle casing when the first cam follower reaches a forward position limit and the rear control switch is actuated by the middle casing when the head reaches a backward position limit.

13. The animation device of claim 1 wherein the actuation motor is reversible.

14. The animation device of claim 7 wherein the activation motor is reversible.

* * * * *